United States Patent [19]

Villard et al.

[11] Patent Number: 4,825,668

[45] Date of Patent: May 2, 1989

[54] INSTALLATION FOR TREATING TEXTILE MATERIALS ON MATERIAL CARRIERS BY MEANS OF A FLUID

[75] Inventors: Francois Villard; Bernard Barriquand, both of Roanne, France

[73] Assignee: Barriquand, Roanne, France

[21] Appl. No.: 932,127

[22] Filed: Nov. 18, 1986

[30] Foreign Application Priority Data

Nov. 18, 1985 [FR] France ..... 85 16990
Dec. 10, 1985 [FR] France ..... 85 18235

[51] Int. Cl.[4] ..... D06B 5/18
[52] U.S. Cl. ..... 68/189; 68/210
[58] Field of Search ..... 68/150, 189, 198, 199, 68/210

[56] References Cited

U.S. PATENT DOCUMENTS

| | | | |
|---|---|---|---|
| 1,052,817 | 2/1913 | Hebden et al. | 68/189 |
| 2,944,318 | 7/1960 | Scholl et al. . | |
| 3,344,622 | 10/1967 | Kronsbein | 68/199 X |
| 4,206,619 | 6/1980 | Fukuroi et al. | 68/189 X |
| 4,341,361 | 7/1982 | Shaikh | 68/189 X |

FOREIGN PATENT DOCUMENTS

| | | | |
|---|---|---|---|
| 0110058 | 6/1984 | European Pat. Off. . | |
| 1460426 | 8/1972 | Fed. Rep. of Germany | 68/189 |
| 1966527 | 12/1972 | Fed. Rep. of Germany | 68/210 |
| 2129254 | 2/1973 | Fed. Rep. of Germany | 68/189 |
| 2555974 | 6/1977 | Fed. Rep. of Germany | 68/189 |
| 501677 | 2/1920 | France | 68/189 |
| 1037833 | 5/1953 | France . | |
| 1235717 | 5/1960 | France . | |
| 2003379 | 2/1969 | France . | |
| 483856 | 4/1938 | United Kingdom | 68/189 |
| 2047761A | 12/1980 | United Kingdom . | |

*Primary Examiner*—Philip R. Coe
*Attorney, Agent, or Firm*—Browdy and Neimark

[57] ABSTRACT

A method and installation are provided for the treatment in an appropriate apparatus of bodies of textile material introduced into and/or removed from the apparatus by means of a material carrier on which the bodies are loaded, the treatment such as washing, bleaching, dyeing or similar being carried out with a fluid flowing through the bodies in a circuit flowing in and out of the apparatus by the bottom thereof and established by matching sealing means provided on the carrier and the apparatus.

13 Claims, 13 Drawing Sheets

INSTALLATION FOR TREATING TEXTILE MATERIALS ON MATERIAL CARRIERS BY MEANS OF A FLUID

BACKGROUND OF THE INVENTION

1. Field of the Invention

The invention relates to a method and installation for treating textile materials on material carriers by means of a fluid.

It provides in particular a method and installation for treating textile materials by causing a bath to flow through said materials, for example, without this indication having any limitative character whatsoever, a washing, bleaching, dyeing or similar bath.

2. Description of the Prior Art

There has already been proposed, for example, in FR-A-2 450 147 an installation comprising a material carrier on which are stacked packages of a textile material to be treated which are loaded and/or unloaded by piles of packages. An installation of this type is also known from DE-A-2 300 838 which also provides for loading and/or unloading the material carrier with packages pile by pile which forms an appreciable progress with respect to older installations in which these operations are carried out package by package. These loading and/or unloading operations are nevertheless relatively time wasting in particular when the material carriers are provided for a large number of piles, as is the case in modern installations.

Furthermore, in these known installations comprising a treatment apparatus comprising a cylindrical tank with vertical axis, the material carriers are positioned in the apparatus by hoisting gear, gantry or travelling crane which, since they are relatively cumbersome, require for their use buildings have a sufficient under ceiling height.

To the above mentioned drawbacks of known installations is further added the fact that the treatment methods used in these installations generally provide for total immersion of the piles of packages in the bath used, so that this latter requires a volume which may be of the order of ten times that of the material so as to fill the whole of the treatment apparatus.

SUMMARY OF THE INVENTION

With respect to this state of the art, the invention provides a method and installation for the treatment of textile materials on a material carrier by means of a fluid, which overcome the drawbacks of known methods and installations.

It is, in particular, an aim of the invention to provide a method for treating textile materials on material carriers which is appreciably shorter to carry out than the known methods.

It is also an aim of the invention to provide such a treatment method which only requires for its implementation a much smaller bath volume than those used up to present.

It is a further aim of the invention to provide an installation for treating textile materials on material carriers using a fluid, which does not need to be placed in buildings which are too large and which, thus, may find an application in units of a more modest size than those equipped with known apparatus.

It is finally an aim of the invention to provide a method and installation for treating textile materials on material carriers by means of a fluid which, while considerably reducing the treatment costs with respect to known methods and installations, lead however to finished products of the same quality as or of a quality superior to that of the products obtained by the prior art methods and installations.

An installation is provided for the treatment in an horizontal tank apparatus of bodies of textile material introduced into and/or removed from said apparatus by means of a material carrier on which said bodies are loaded, said treatment such as washing, bleaching, dyeing or the like being carried out with a fluid flowing through said bodies in a circuit flowing in and out of said apparatus by the bottom thereof and established by matching sealing means provided on said carrier and said apparatus, respectively.

Bodies of textile material, as used in this specification and appended claims has the meaning of packages such as bobbins of thread, yarn, fibers or tops or twos or else skeins or similarly shaped bodies of textile material.

A method in accordance with the invention for treating in an appropriate apparatus packages of textile materials introduced, in and/or removed from said apparatus by means of a material carrier on which said packages are adapted to be stacked one above the other, said treatment, such as washing, bleaching, dyeing or similar being effected by means of a treatment bath fluid flowing through said materials, is characterized in that the loading of said packages on the material carrier takes place by simultaneous positioning of a plurality of piles of packages, and in that unloading of said packages from the material carrier also takes place by simultaneous removal of said plurality of piles of packages.

Thus a considerable saving in time is achieved during operations for loading and/or unloading textile materials on/or from material carriers.

According to an advantageous characteristic of the invention, the loading and/or unloading of the plurality of piles of packages is achieved by grouping, at the output of the spinning and packaging means, said piles of packages together on a handling module where they are evenly disposed.

In a preferred embodiment, the regular arrangement of the piles of packages is, seen from the top, of the row and column type, and the module has a substantially rectangular cross section.

In yet another preferred embodiment, the cross section or plan contour of the module corresponds to that of a transport trolley adapted to receive it and which serves for moving the module between the output of the packaging and spinning means and a station for loading the material carriers.

These latter are organized for receiving a whole number of modules, that is to say that the relative arrangement and the number of spindles for the material carriers are chosen to correspond to the arrangement and number of piles of yarn packages carried by the assembly of modules provided for cooperating with said material carrier.

An installation in accordance with the invention for treating bodies of textile materials on a material carrier which may be introduced in and/or removed from a bath fluid treatment apparatus and on which the bodies are loaded, with means for transporting said material carrier equipped with means for moving over the ground, into and/or out of the treatment apparatus, is characterized in that the treatment apparatus comprises an external horizontal axis enclosure with at least one input and output door of the material carrier, a fluid input and a fluid output in the bottom of said enclosure and in that means are provided on said carrier and on said enclosure for establishing and ensuring the continuity of a circuit for the treatment fluid from an apparatus causing circulation thereof.

In a preferred embodiment, the enclosure of the treatment apparatus has a generally parallelepipedic form, with a cross section corresponding to that of one or advantageously of a multiplicity of carriers.

In another embodiment, the treatment apparatus has an enclosure of a cylindrical external shape but then includes, inside said enclosure sealed caissons with vertical walls defining one or more parallelepipedic parts.

In one advantageous embodiment, the input and output door or doors of the treatment apparatus is (are) a vertically sliding door or doors.

The material carrier is adapted to be moved over the ground on wheels or on slides, or any other convenient displacement means and the installation preferably comprises rails, or tracks or wire means for guiding the material carrier in its translational movements, for introduction into and/or removal from the treatment apparatus.

The invention also associates with the means for moving the material carrier over the ground means organized so as to allow a vertical translational movement of the material carrier with respect to the ground, this movement being used for establishing and ensuring in the treatment apparatus the continuity of a flow circuit for the treatment fluid.

An installation in accordance with the invention allows short or very short bath ratio to be used of the order of ¼, with consequently appreciable saving in water, heating energy and amounts of chemical products.

As far as the treatment fluid in particular is concerned, the invention provides that the apparatus is organized so as to allow flow of said fluid at will from the inside to the outside of the bodies or in the opposite direction, that is to say from the outside to the inside or else, alternately, in one direction and in the other.

The treatment apparatus may operate at atmospheric pressure.

In a modification, its operation is of the pressurized autoclave type with compressed air static pressure, or inert gas static pressure. In this case thermal expansion of the bath fluid takes place in the air or inert gas cushion located above the bath level.

An installation of the invention lends itself particularly well to the automation of its operation, in particular to robotization.

BRIEF DESCRIPTION OF THE DRAWINGS

The invention will be better understood from the following description, given by way of example with reference to the accompanying drawings in which.

DESCRIPTION OF THE PREFERRED EMBODIMENTS

Figure 1:
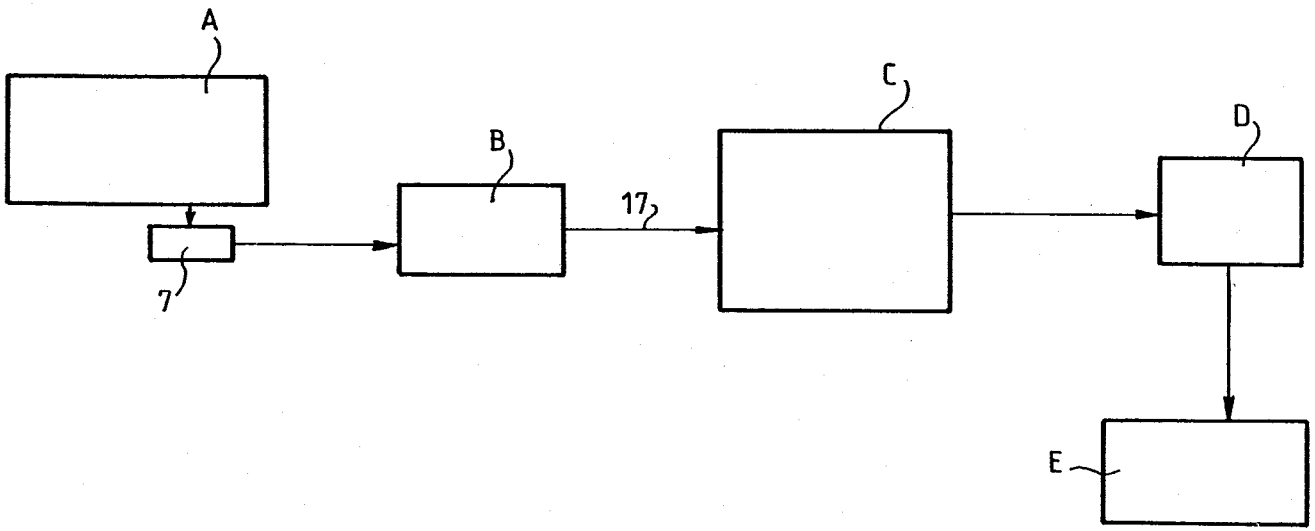
FIG. 1 is a schematical top view of an installation according to the invention.

Reference is made first of all to FIG. 1 which shows very schematically an installation according to the invention for treating textile materials on material carriers by means of a fluid, for package type bodies.

Such an installation includes a packaging and spinning station A, a station B for loading the packages coming from station A onto material carriers, an apparatus C for treating the textile materials in the form of packages of thread, yarn, ribbons or similar, a station D for unloading the material carriers on leaving apparatus C and a station E where said treated textile materials are taken up for a subsequent operation.

Figure 3:
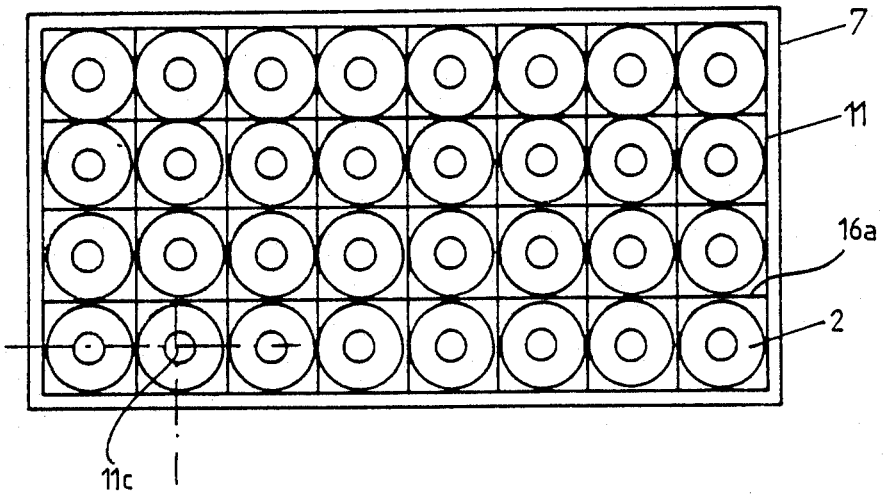
FIG. 3 is a corresponding top view thereof.
Figure 2:
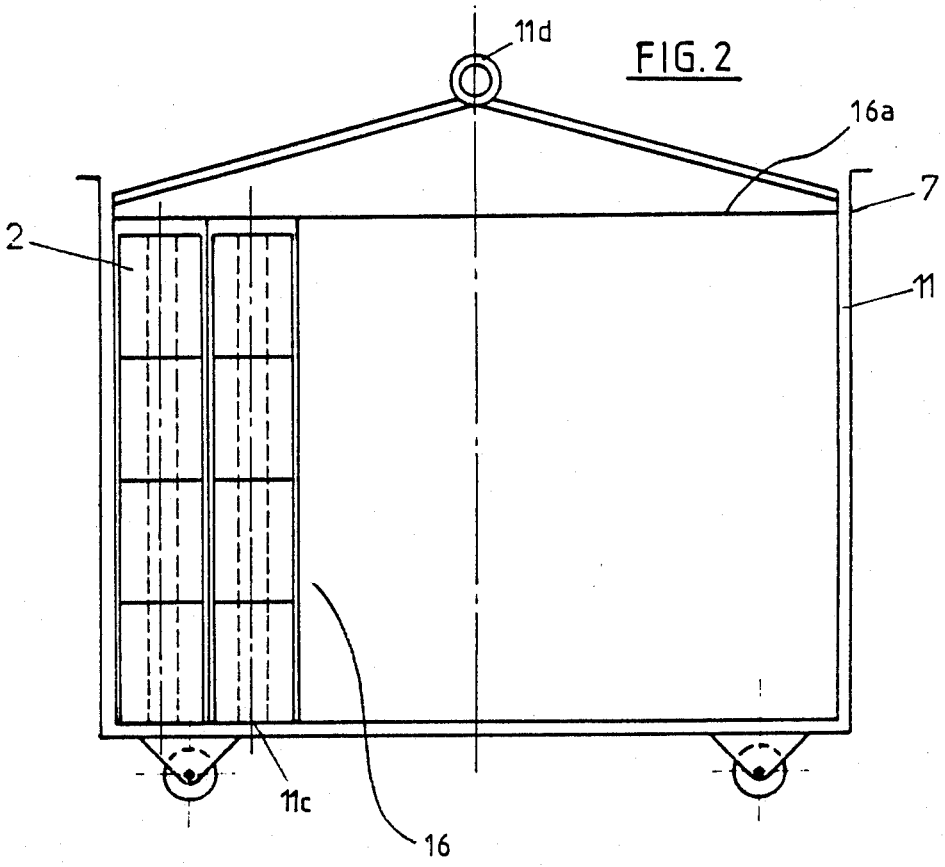
FIG. 2 is an elevational view of a transport trolley comprising a module of an installation according to the invention.

According to the invention, the packages 2 coming from the packaging and spinning means A are positioned on a storage module 11 placed before the beginning of loading of the packages 2 on a trolley 7, FIGS. 1, 2 and 3.

In the embodiment described and shown, said module has a rectangular contour viewed from the top and includes partitioning and gripping means 16 defining as seen from the top a row and column pattern of piles of 3, 4 or 5 packages, each with axis 11*c* at the intersection of a line and a column.

Figure 4:
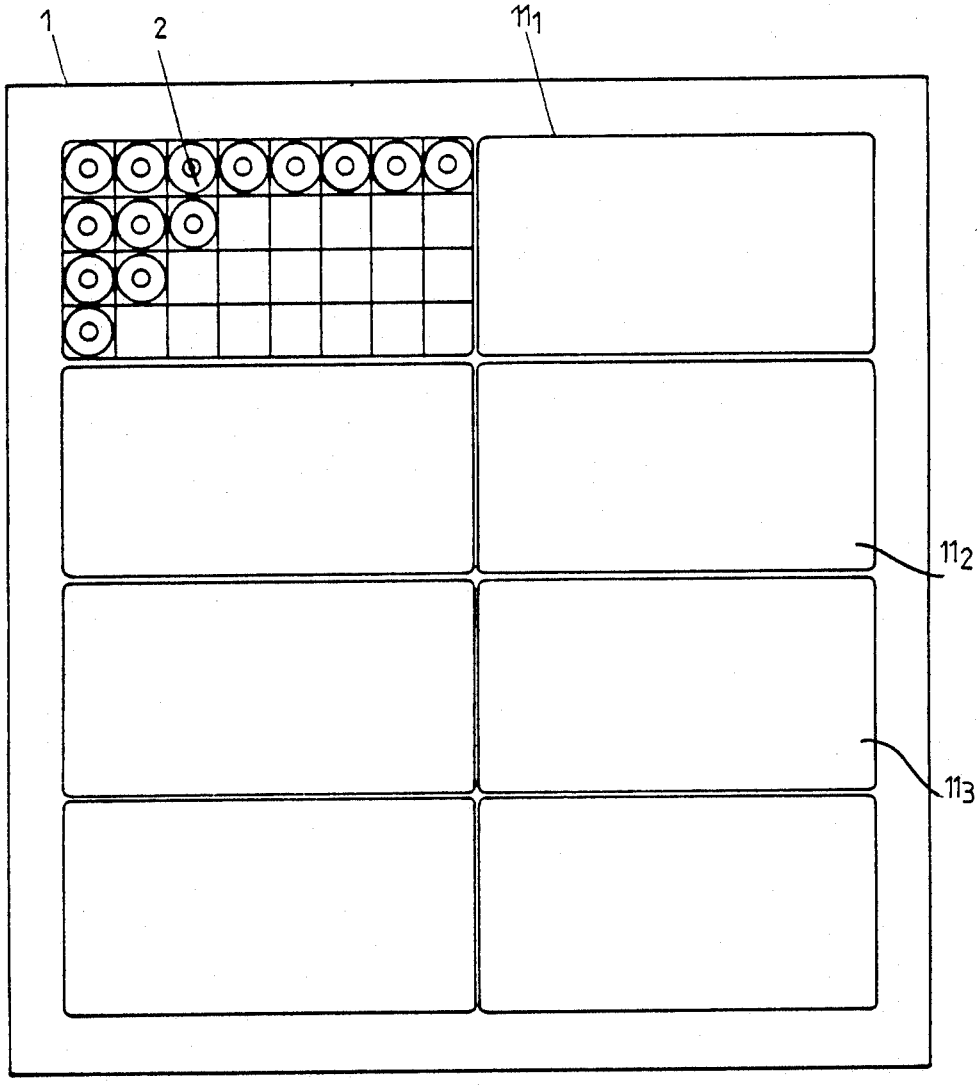
FIG. 4 is a schematical top view of a material carrier adapted to be used in an installation according to the invention.
Figure 4A:
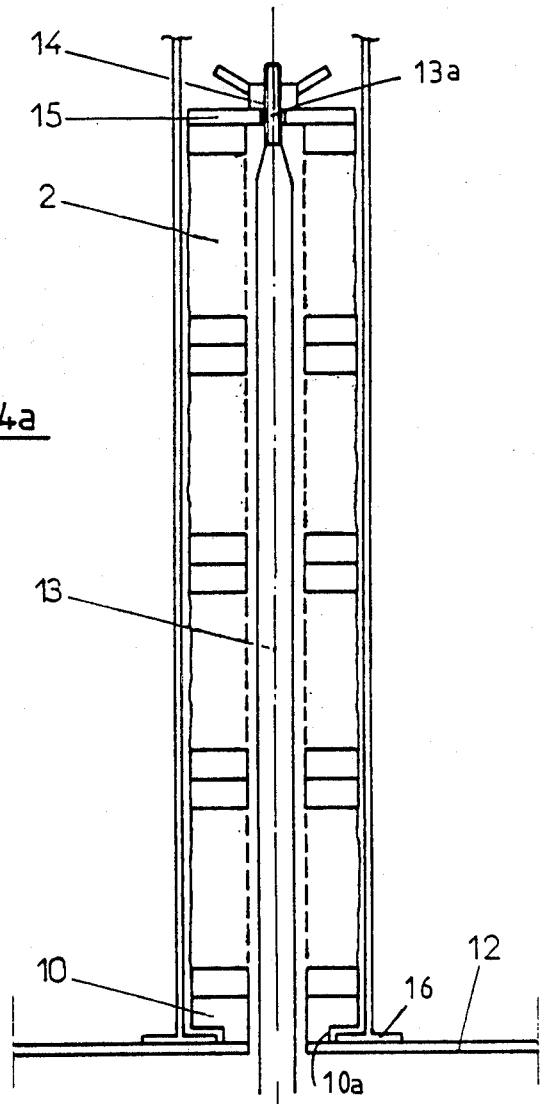
FIG. 4*a* is a detailed view on a larger scale.
Figure 4B:
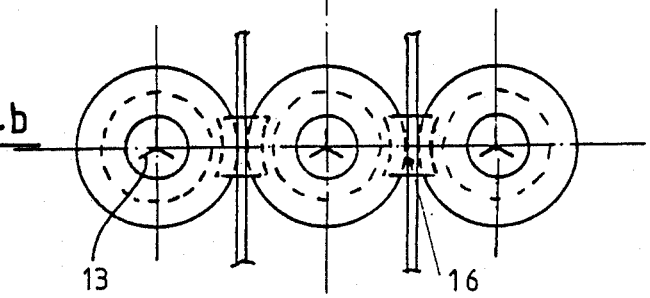
FIG. 4*b* is a corresponding plan view.

As can be seen in FIGS. 4*a* and 4*b*, each pile of packages 2 rests on a tubular base 10 having a recess 10*a* for cooperating with a means 16 for gripping the piles. All the partitioning and gripping means 16 are firmly secured together at their upper part by a rigid grid 16*a*, FIG. 2, with which is associated, at the top part, an eye 11*d*, FIG. 2 which, when the module loaded with packages is brought by trolley 7 to station B, allows the simultaneous loading on the material carrier 1 of the whole of the packages of a module.

More precisely, each pile of packages is fitted by the axial channel which it comprises on a perforated tube spindle or a bayonet 13 with star profile whose top end 13*a* is threaded and which is integral with the material carrier 1. The spindles or bayonets 13 of the carrier being disposed on the upper plate 12 of the caisson 12*a* of the material carrier in geometric correspondance with the piles of packages 2 loaded on module 11, it is the whole of the packages of the module which is loaded onto the material carrier 1 in a single transfer operation.

Following this operation, each pile of packages 2 rests on the plate 12 of the caisson 12*a* of the material carrier 1 through a base 10, which ensures simultaneously sealing in contact with said plate, whereas the solidity of each pile is reinforced by positioning, in the top part of the pile, a clamping device comprising a plate 15 and a nut 14 adapted for cooperating with the threaded part 13*a* of a bayonet 13 and advantageously common to a plurality of piles.

The dimensions and the contour in a top view of a material carrier 1 are preferably as shown in FIG. 4, that is to say provided so as to allow loading of a certain number of modules 11, for example eight in the examples shown, and which are referenced $11_1$, $11_2$, $11_3$, . . . etc.

Figure 5:
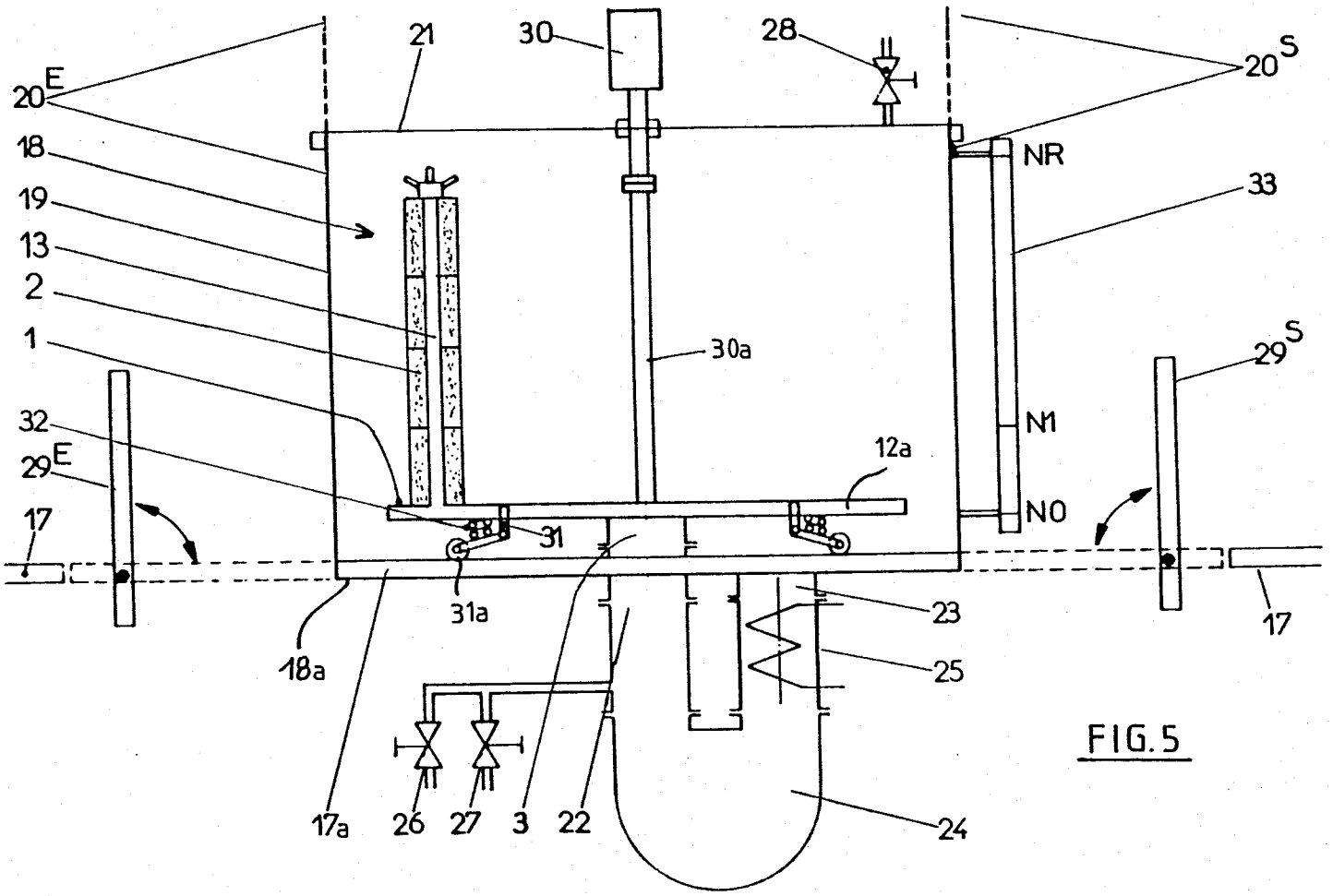
FIG. 5 is a schematical view of a treatment apparatus of an installation according to the invention for a first embodiment.
Figure 6:
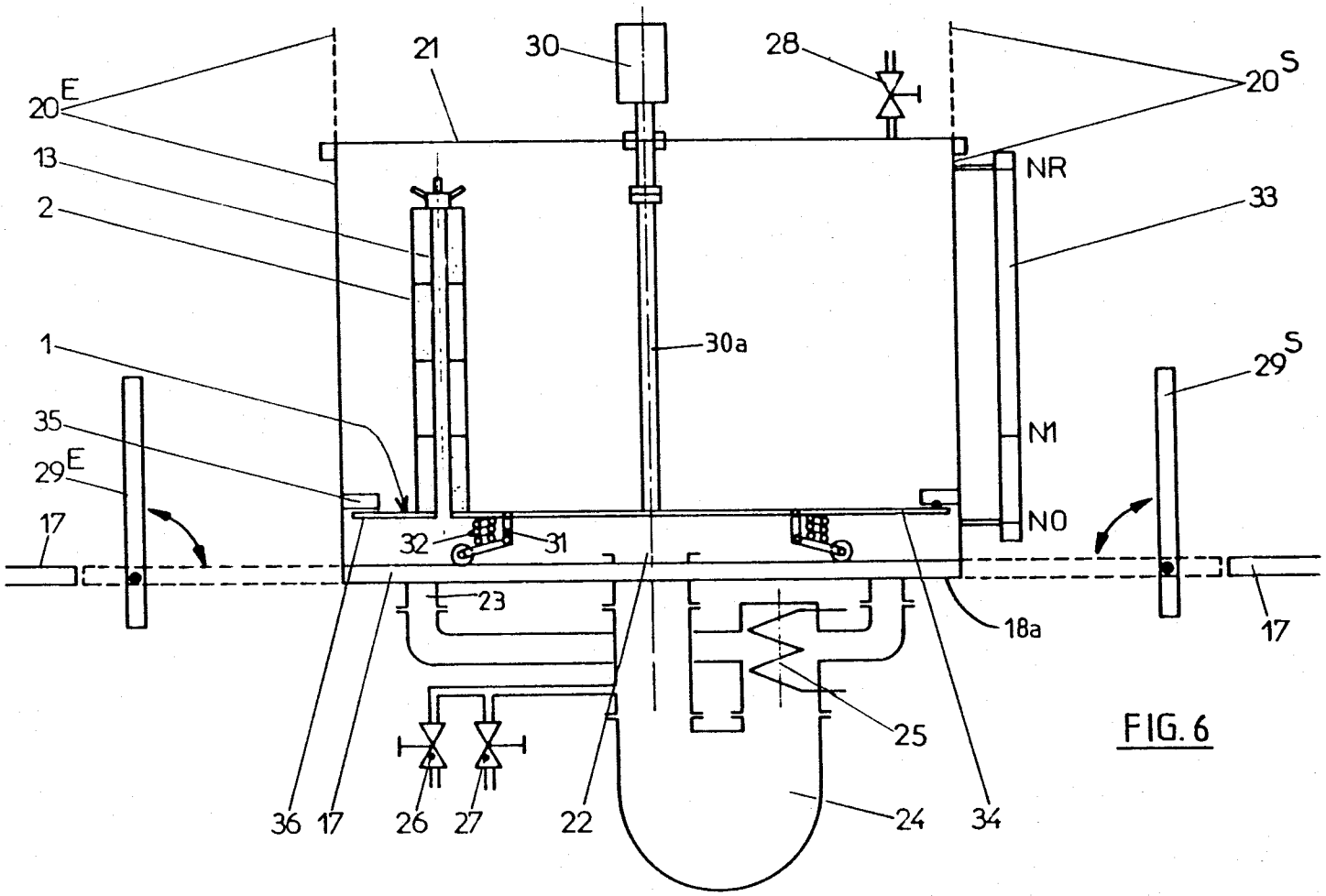
FIG. 6 is a view similar to that of FIG. 5 but for a variant of construction.
Figure 7:
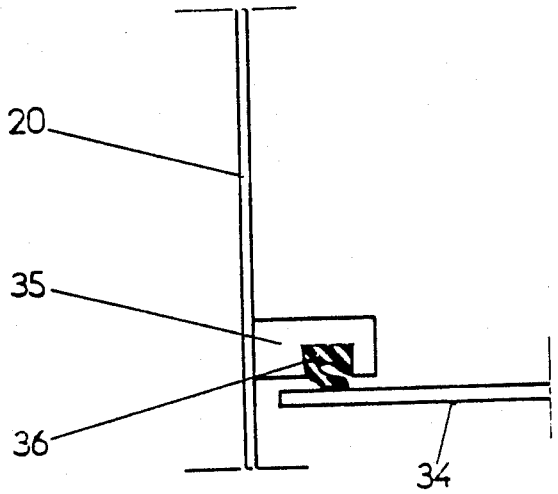
FIG. 7 is a detailed view on a larger scale.

After the material carrier 1 has been loaded in station B, it is transferred to station C where the treatment apparatus 18 is located. As shown in FIG. 5, this latter comprises, in a first embodiment, a parallelepipedic tank 19 whose cross section corresponds to that of a material carrier and which is provided with input and output doors 20E and 20S, respectively, formed here as vertical sliding doors, other constructions being of course possible, for instance one single sliding door opposite a closed end of the tank or vessel 19, or one pivoting door 20, FIG. 10.

In its upper part, tank 19 is closed by a fixed cover 21 through the center of which passes a clamping device 30, the role of which will be described hereafter, whereas on the bottom 18*a* of the tank 19 are laid rails 17*a* with which cooperate the wheels 31*a* of four axle devices 31 fixed to the caisson 12*a* of the material carrier and with which are associated spring devices 32 adapted for allowing a vertical movement from bottom to top and/or from top to bottom of the material carrier with respect to rails 17*a*.

In the bottom 18*a* of the apparatus 18 is provided a central input 22 for the treatment fluid with which an end piece 3 integral with caisson 12*a* is adapted to sealingly cooperate, as will be described hereafter, for introducing the fluid into the caisson 12*a* of the material carrier 1, the return flow of the fluid taking place through an end piece 23, also in the bottom 18*a* next to which is provided a heat exchanger 25, advantageously of the type described in FR-A-2 423 967.

This treatment fluid bath, introduced into apparatus 18 from a valve 26 and whose height in tank 19 is visualized by means of a level tube 13, is caused to flow by a pump 24, a valve 27 being provided for draining at the end of the treatment cycle.

The latter takes place at atmospheric pressure or under pressure depending on the condition of a valve 28 of cover 21 which also serves as overflow valve. When the treatment is carried out under pressure a static compressed air or inert gas cushion is provided above the bath level and thermal expansion of the fluid bath takes place in this cushion.

Figure 8:
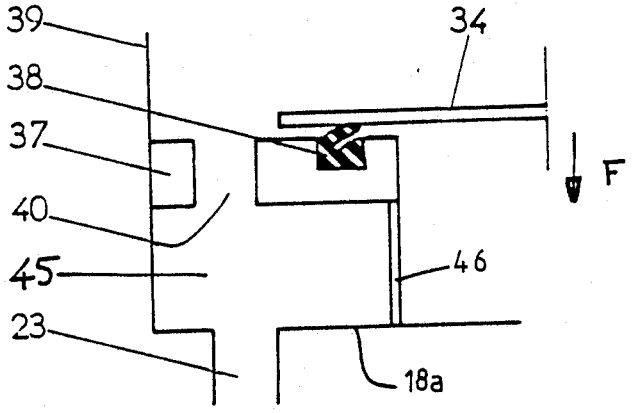
FIG. 8 is a detailed view on a larger scale.
Figure 9:
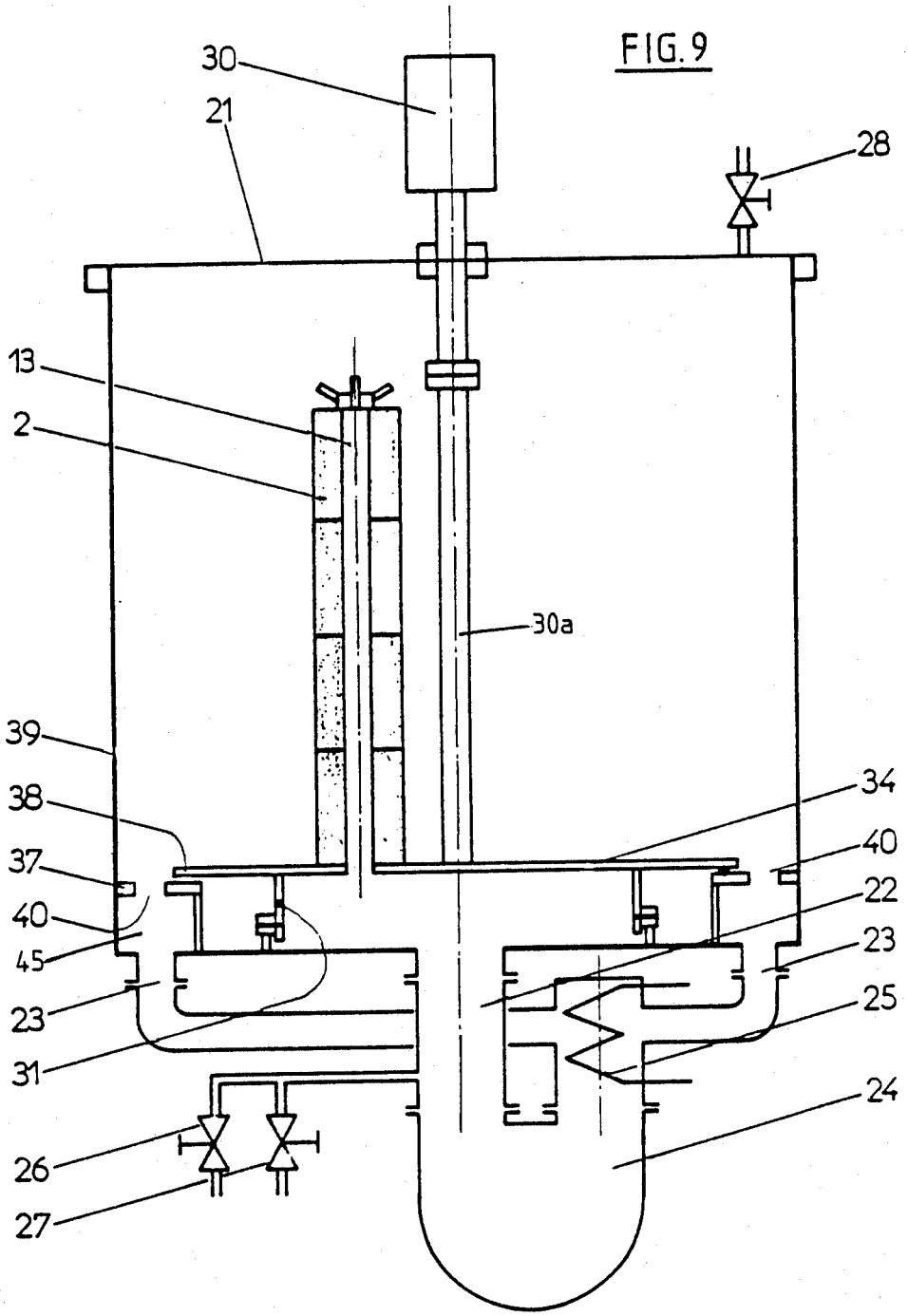
FIG. 9 is a view of a part of the apparatus illustrated in FIG. 6 but taken at 90° therefrom.

In the modification illustrated in FIGS. 6 to 9, the caisson 12*a* of the material carrier is replaced by a plate 34 with upright spindles or bayonets 13, as described above, and which, as in the preceding embodiment, is equipped with axle devices 31 with which spring devices 32 are associated. In this modification, however, the treatment fluid bath—introduced by end piece 22 in the center of tank 39 and in the bottom thereof—returns to the flow circuit through several end pieces 23, also located in the bottom of the tank. As can be seen in FIGS. 8 and 9, these end pieces 23 are provided below spaces 45 defined by the lateral wall of tank 39, bottom 18*a*, a vertical wall 46 inside the tank erected from the bottom 18*a* thereof and a plate 37 fixed to the lateral wall of the tank and to wall 46; in plate 37 pierced with orifices 40, are mounted seals 38 with which the lower face of the plate 34 of the material carrier 1 is adapted to cooperate, while similar seals 36 are provided on the inner face of fixed bars 35 on doors 20E and 20S, of the apparatus, FIGS. 6 and 7, or on the unique door when one door only is provided. In this case, that is a vessel 19 comprising a single door, the invention also contemplates to provide the vessel with a vertical partition wall in the vicinity of the rear closed end of the vessel, said wall opened in the base thereof enabling thermal expansion of the fluid bath as described in U.S. Pat. No. 4,581,906 incorporated therein by reference.

The operation of one and other of the embodiments described is as follows:

In the embodiment shown in FIG. 5, the material carrier provided at station B with bodies shaped as packages 2 is introduced into the treatment apparatus 18 after the input door 20E has been raised (position shown with broken lines in the drawing) and after pivoting connection rails 29E have been brought into position, also shown with broken lines, for ensuring the continuity of the travelling path between the rails 17 laid between station B and the treatment apparatus 18 and the rails 17*a* of said treatment apparatus. After precise positioning of the material carrier 1 inside tank 19, the clamping means 30 are actuated for cooperating with a central column 30*a* of the material carrier and for providing sealing contact of the end piece 22 for introducing the treatment bath fluid into the apparatus with the end piece 3 through which said fluid penetrates into the caisson 12*a* of the material carrier 1. During actuation of means 30, the spring devices 32 of the axle devices 31 are compressed by lowering of the caisson 12*a* of the material carrier, providing sealing for the flow circuit of the treatment fluid.

This latter is introduced into apparatus 18 through the valve 26, after closure of the input door 20E and the level of the bath is adjusted between positions $N_O$ and $N_R$ of the level tube 33, as a function of the requirements of practice. The level is for example adjusted to value $N_1$ for treatment of the "non immersed" type, that is to say a treatment in which only the package 2 of the piles of packages adjacent plate 12 is totally or partially immersed. The treatment bath is then set in circulation by means of pump 24 so as to cause the bath to flow from the inside towards the outside of the packages, or form the outside towards the inside or else in both directions alternately.

By an appropriate choice of the drive motor of the pump, the delivery rate of this latter may be adjusted so as to obtain perfect control of the flow of the treatment fluid through threads, yarns and ribbons forming the packages with a resulting better quality of the treated textile material because of the absence of sudden variations of flow rate through the material windings.

Furthermore, this arrangement allows the treatment to be effected with a small bath ratio, of the order of ¼, that is to say with substantial savings in water, heat provided by the heat exchanger 25, chemical treatment products and/or rejects.

At the end of the treatment means 30 are made inoperative, the spring devices 32 cause a slight upward movement of caisson 12*a*, freeing the axle devices 31 and thus interrupting the continuity of the flow circuit for the bath fluids.

The output door 20S of apparatus 18 is opened by bringing it to the position shown with broken lines in the Figure and, after the connecting rails 29S have been brought by pivoting into the position also shown with broken lines in said Figure, the material carrier 1 is removed from the apparatus 18 and is guided by travelling over rails 17 as far as station D where it is unloaded.

In a one door apparatus exit of the carrier is through this door which also served as entrance door.

The time for loading and unloading a material carrier of an installation in accordance with the invention is considerably reduced with respect to that of known installations, the time for loading and/or unloading eight modules each having 128 packages (32 piles of 4 packages) being very much less than the time for handling one thousand and twenty four packages one by one (8×32×34).

In the embodiment shown in FIGS. 6 to 9, the introduction of the material carrier 1 in the treatment apparatus 18 is similar to that described above except that when the means 30 are made operative for cooperating with the central column 30*a* of the material guide, the downward movement of plate 34, as shown by arrow F in FIG. 8, causes said plate to be applied against the sealing means 38 whereas closure of door or doors 20 apply the seals 30 sealingly against the above face of said plate. After filling and adjustment of the level of the bath, as described above, the bath circulating pump 24 is made operative so as to cause this latter to flow from the inside towards the outside of the packages, or from the outside towards the inside, or alternately in one direction then in the other. In the first case, the bath delivered by pump 24 through the central end piece 22 penetrates into tank 39 under the plate 34 of the material carrier 1, passes through the packages 2 through the central orifice of the piles and returns to the pump through the orifices 40, spaces 45 and end pieces 23.

It is a reverse direction of flow which is used for treating textile materials by causing the treatment bath to flow through the windings from the outside towards the inside. In this embodiment, also, the treatment may be carried out at atmospheric pressure or under air or inert gas static pressure and, hereagain, with a short or very short bath ratio, of the order of ¼ appreciably less than that of known prior art installations (values of the order of 1/10).

The invention also provides, in one and/or other of the above described embodiments for robotizing the operation of the installation both in so far as loading and/or unloading of the modules 11 are concerned and in so far as the positioning and/or removal of the material carrier 1 in the treatment apparatus 18 are concerned.

Movement over the rails, in an horizontal plane, of the material carrier on entering and on leaving the treatment apparatus, the structure of the treatment apparatus with sliding doors as well as the central clamping system for the material carriers makes such robotization relatively simple.

Although the invention has been described with reference to a treatment apparatus tank having a general parallelepipedic shape, it is clear that the invention is not limited to this embodiment.

Figure 10:
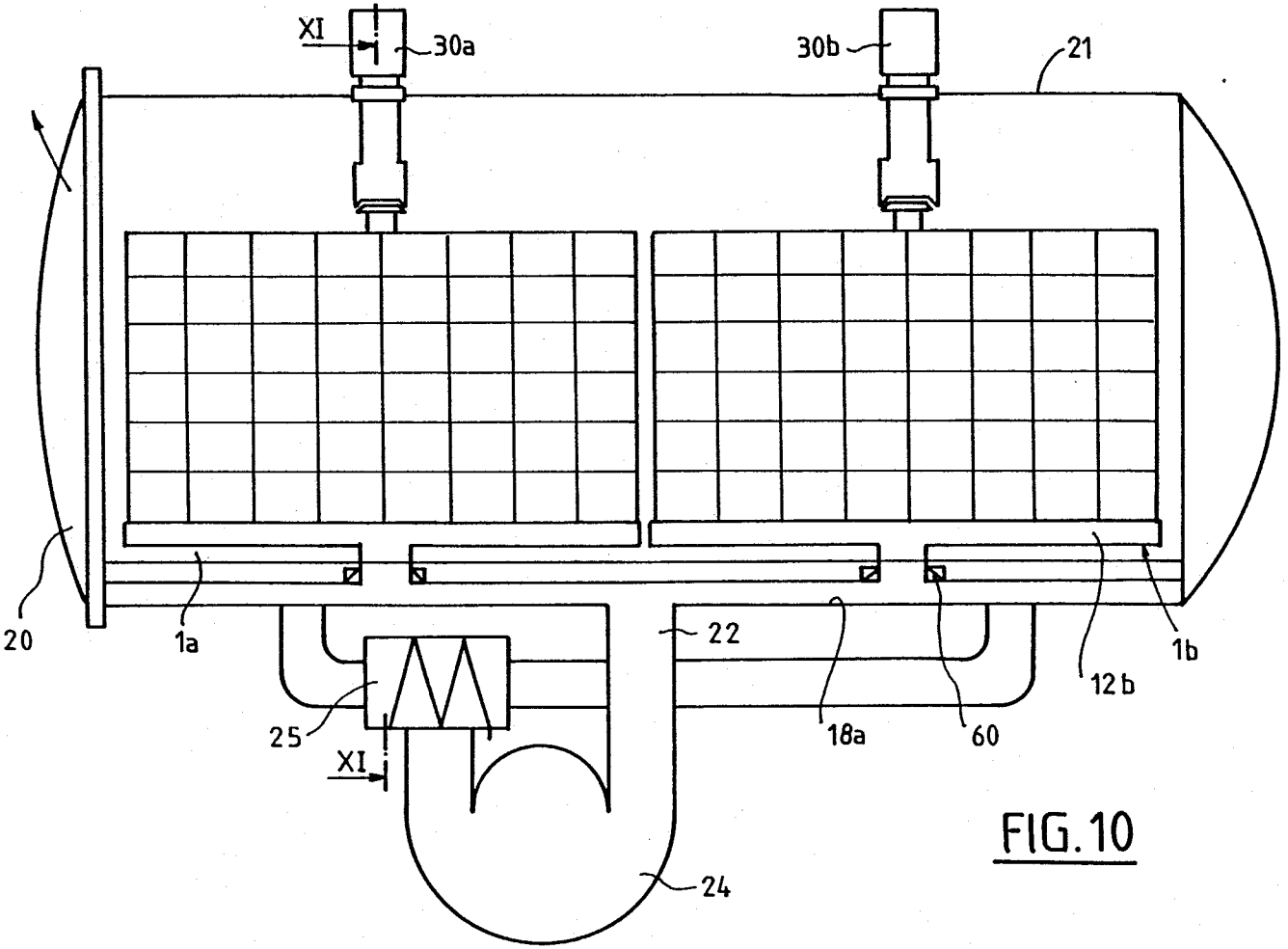
FIG. 10 is a schematical longitudinal section of an apparatus according to the invention.
Figure 11:
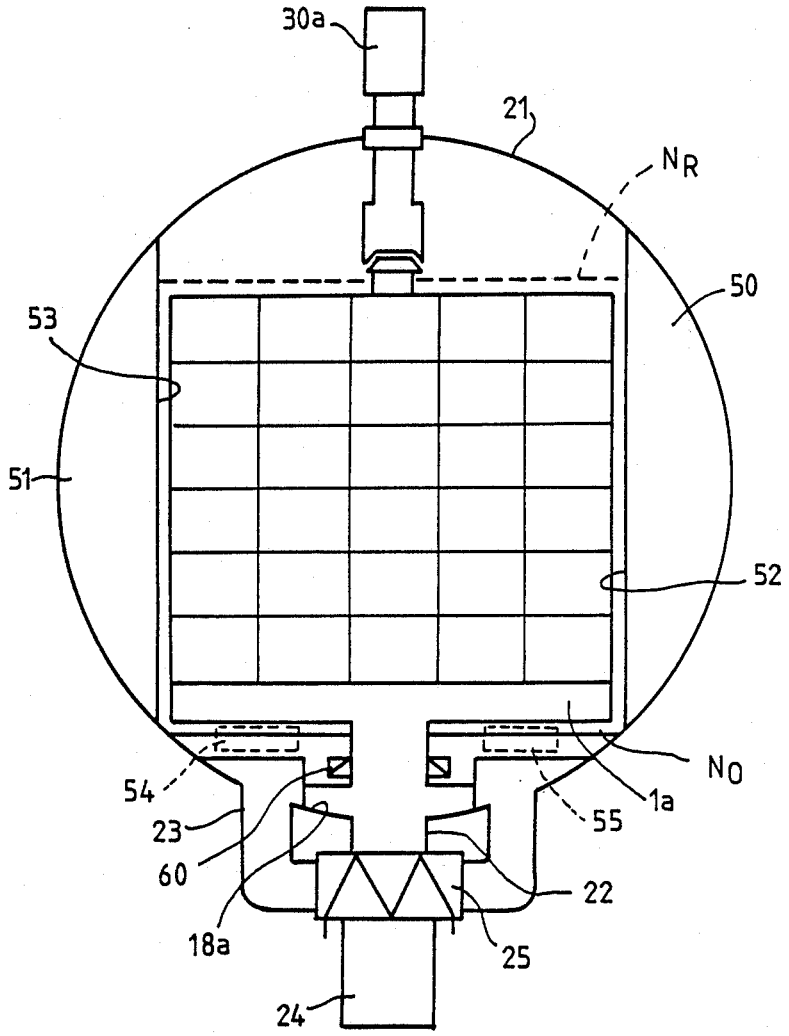
FIG. 11 is a section along line XI—XI of FIG. 10.

The invention may, in particular, be implemented in an installation including a treatment apparatus with an horizontal cylindrical external tank provided on the inside with vertical partioning means defining sealed caissons each having a parallelepipedic shape. This embodiment shown on FIGS. 10 and 11, is provided to accomodate two carriers 1*a*, 1*b* each receiving four modules of ten piles each. The length of the tank is of about 5 meters and the diameter thereof about 1.8 meters with the sealed caissons 50 and 51 defining by their vertical partitions 52 and 53 a substiantially parallelepipedic volume for the carriers. The apparatus comprises the heat exchanger 25, a pump 24, advantageously a helico centrifugal, two directions working pump, and the means 54 and 55 for guiding the carriers upon loading and unloading of the tank, said means being rails or tracks or slides or wire type means. In this embodiment two clamping means 30*a* and 30*b* are provided passing through the cover 21. In this embodiment also the fluid flows through the bodies in a circuit defined by openings in the bottom 18*a* of the tank and which lead to a piece 22 connected to pump 24 and the pieces 23 also opening in the bottom 18*a*. The sealing means for establishing the fluid circuit are shown at 60.

In this embodiment similarly to what is shown on FIG. 5, the fluid level can be adjusted at $N_O$ for a treatment of the "non-immersed" type, that is with none of the packages being touched by the bath in the inoperative condition of the pump, or at any level between $N_O$ and $N_R$ (dotted line in FIG. 11) where all the packages are in the bath even when the pump 24 is inoperative.

Reference is now made to FIGS. 12 to 16 which show an apparatus according to the invention for the treatment of bodies shaped as skeins of yarns, fibers, or similar textile materials. The material carrier is then made of a vat 110 having a bottom 112 and a lateral wall 111 comprising an opening 113 adapted to be closed by a door 114, for instance a vertically sliding door. On the bottom 112 is provided an end piece 115 for connecting the inside volume V of the vat with the fluid circuit of the tank, for instance via end piece 22 connected to pump 24. Inside vat 110 are located two couples of members parallely disposed one at the vicinity of the upper part of wall 111, the other one at the vicinity of bottom 112. 116 designates a member of the first couple and 117 a member of the second couple.

The distance separating couple of members 116 from couple of members 117 is adjustable to fit the length of skeins E which are placed on bars B and C, the first ones being to support the skeins by their upper loops whereas the second ones are used to avoid that said skeins get mixed with one another. When door 114 is opened, the skeins are placed into the carrier, as shown by arrow f that is with bars B riding on the couple of members 116 and with the bars C extending through the lower loops of the skeins under the couple of members 117. Said members 116, 117 are simple bars or rails. In a modification members 116 are bars and members 117 are slides adapted to receive bars C so that a slight shrinkage is made possible for the skeins E. In still another modification both couples of members 116, 117 are slide means in which are guided the bars B and C.

Figure 13:
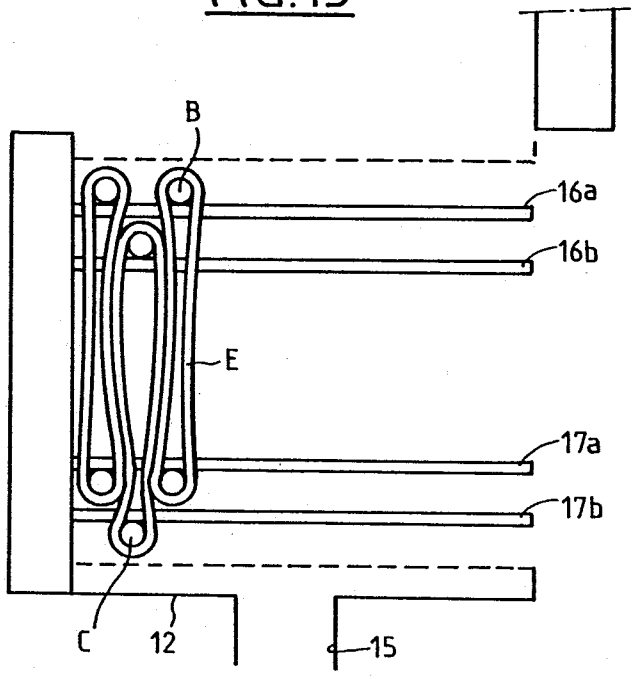
Figure 15:
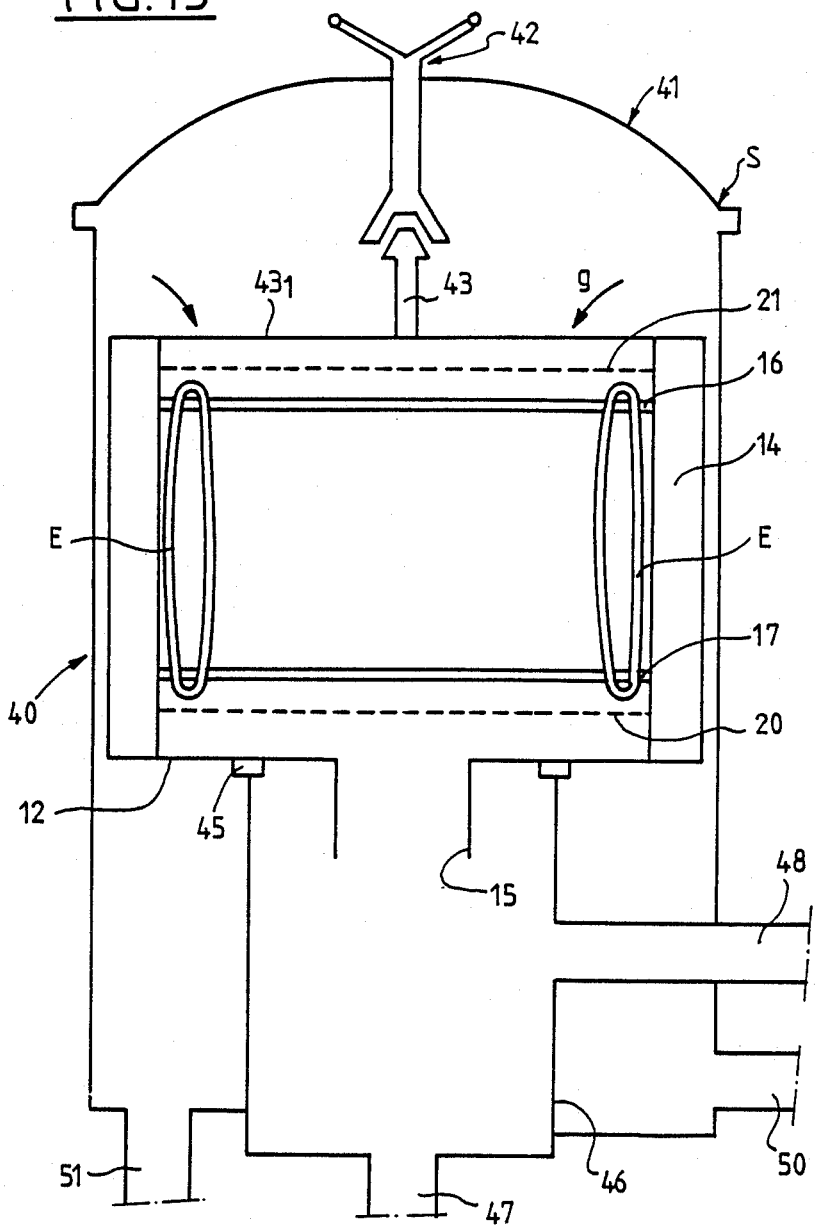
FIG. 15 shows said carrier in an enclosure of an apparatus.

In the embodiment of FIG. 13 bars B ride alternately on one and the other of two first couples of members 116*a* and 116*b* offset with respect to the bottom 112 thus enabling a greater loading density and a better treatment, the textile materials being at no point of the skeins pressed between adjacent bars.

When rails 117*a* and 117*b* are provided, they are also offset in height, to match the position of rails 116*a* and 116*b*.

Figure 14:
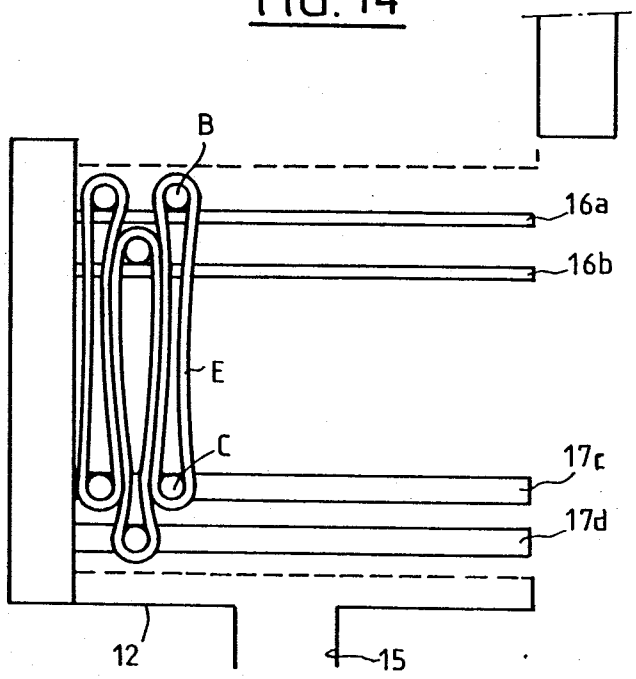
FIGS. 13 and 14 are similar to FIG. 12 but for modifications.

In the embodiment shown in FIG. 14 the lower members 117*c* and 117*d* adapted to receive bars C are slide means which are also offset in height to match the setting of rails 116*a* and 116*b*.

To enhance a good treating fluid distribution inside the vat, the same comprises grids disposed in parallel relationship to the bottom 112, one in the vicinity of the top, 121 and the other one 120 in the vicinity of the bottom.

Figure 16:
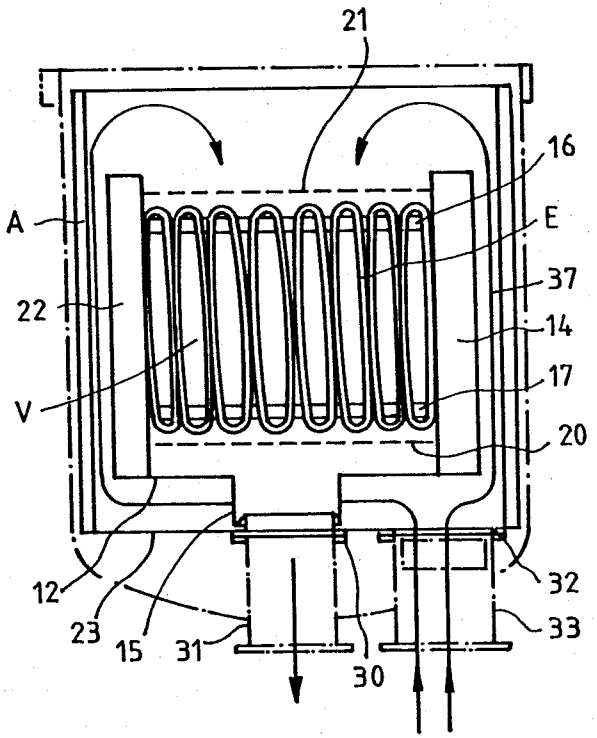
FIG. 16 is similar to FIG. 15 but for another embodiment.
Figure 12:
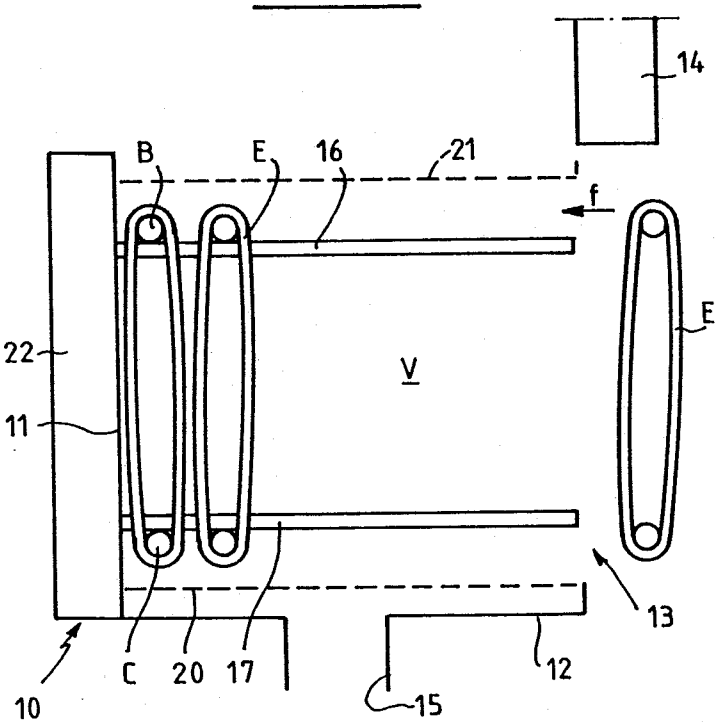
FIG. 12 shows schematically a material carrier for skeins adapted to be used in an apparatus according to the invention.

Treatment of skeins is particularly advantageous with a carrier as described. If, for instance, the length of bars B is adapted to that of the arms of a mercerising machine, the content of each of said arms is transferred on a bar B and placed in the carrier, and said carrier is used in all the treatment apparatuses thus avoiding to resort to intermediary vats as was usual up to now. Typically, once the carrier is loaded it is transferred for washing, bleaching or dyeing of the skein shaped material bodies to an apparatus as shown in FIGS. 10 and 11, that is an horizantal tank type apparatus comprising a reversible fluid circulating system or to an apparatus as shown in FIG. 16 which comprises a pressurized container A, the floor 123 of which is opened at 130 for the connection of a conduit 131 and is also provided with an opening 132 connected to a conduit 133, both said conduits being connected to a fluid pump, not shown. Said fluid circulates as shown by the arrows, or in the reverse direction, at will, grids 120 and 121 providing a good fluid repartition on skeins E.

After completion of the washing, bleaching or dyeing treatment, the carrier is taken out of container A and introduced, for instance, on a drying machine of the type described in U.S. application Ser. No. 848,142 filed on Apr. 4, 1986, and incorporated herein by way of reference. In such a drying machine comprising a tank 140 and a cover 141, the cover is provided with means 142 adapted to cooperate with matching means 143-143$_1$ resting on the upper face of the carrier to apply the same with sufficient pressure on the sealing means 145 integral with a header box 146 of the drying machine. In said header box 146, open conduits 147 and 148 for the input or output of fluid into or out of the carrier, the output or input, respectively, being by means of conduits 150 and 151 which open in tank 140, at the bottom part thereof.

In a first mode of operation the treating fluid (air for instance) is introduced through conduit 150, flows through grid 121, as shown by arrows g, comes into contact with the skein shaped bodies E and exits from the apparatus through end piece 115 and either one or both of conduits 147, 148. In another mode of operation circulation of the treating fluid is opposed to the one just described, that is with an entry through conduits 147 or 148 and an exit through conduits 150 and/or 151.

We claim:

1. An installation for the treatment of bodies of textile material by means of a treating fluid in an apparatus comprising a tank provided with a reversible fluid circulating system, a material carrier adapted to be received in said tank and to exit therefrom to respectively load and unload said apparatus with said bodies, at least one lateral door in said tank for the input and output of said carrier, guiding means in the vicinity of the bottom of said tank for the guiding of said carrier, means on said carrier for movement on said guiding means, input and output openings of said fluid circulating system in the bottom of said tank, an inner vertical cross section of which corresponds substantially to that of said carrier loaded with said bodies and matching sealing means provided on said carrier and in the vicinity of said openings, respectively, for establishing and ensuring the continuity of said fluid circulating system.

2. The installation as claimed in claim 1, wherein the external enclosure of the treatment apparatus tank is cylindrical and said inner cross section is of substantially rectangular shape to provide a substantially parallelepipedic carrier receiving volume, said volume being limited by substantially vertically expanding walls of sealed caissons located inside said tank.

3. The installation as claimed in claim 1, wherein the input and output door of the treatment apparatus is a vertically sliding door.

4. The installation as claimed in claim 1, further comprising spring means for displacing said material carrier with respect to the ground, from bottom to top or from top to bottom along a translational movement.

5. The installation as claimed in claim 1, wherein said bodies are packages, and wherein said carrier is adapted to be loaded and unloaded with packages carrying modules.

6. The installation as claimed in claim 5, wherein each module is provided with partitioning and gripping means secured together at their upper part by a rigid grid whose pattern corresponds to the pattern, seen in a top view, of the distribution of the piles of packages.

7. The installation as claimed in claim 5, further comprising a transport trolley adapted to receive the module(s) at their loading station and transport the same to a carrier loading station.

8. The installation as claimed in claim 5, wherein said carrier is fitted with upright spindles, said carrier being adapted to receive a whole number of modules, the relative arrangement and the number of said upright spindles being chosen so as to correspond to the arrangement and to the number of piles of packages carried by the assembly of modules provided for cooperating with said material carrier.

9. The installation as claimed in claim 8, wherein the carrier further comprises a caisson, spindles in an even arrangement corresponding to that of at least one module for handling the packages, means for moving it in a horizontal plane, spring means for allowing a slight vertical movement, from top to bottom or from bottom to top of the caisson with respect to a horizontal plane on which it rests, and conduit means for connecting said caisson to said fluid circulating system.

10. The installation as claimed in claim 1, wherein said bodies are skein shaped bodies and said carrier comprises a vat of substantially parallelepipedic shape, a door for closing said vat, at least one couple of members for supporting the upper loops of said skeins, said members being disposed in parallel relationship in the vivinity of the upper part of said vat, and means at the bottom of said vat for connecting the inside volume thereof with said fluid circulating system.

11. The installation as claimed in claim 10, wherein the carrier further comprises grid means for the fluid repartition inside said vat volume.

12. The installation as claimed in claim 10, wherein said carrier comprises at least one second couple of members extending in the vicinity of the bottom of said vat and intended to maintain bars extending through the lower loops of said skeins.

13. The installation as claimed in claim 1, further comprising a cover, means on said cover for venting the inside of said tank, and means for clamping the material carrier located on said cover.

* * * * *